US010955187B2

(12) United States Patent
Scalf

(10) Patent No.: US 10,955,187 B2
(45) Date of Patent: Mar. 23, 2021

(54) REFRIGERATOR WITH QUICK FILL DISPENSER INCORPORATING REMOVABLE FLUID STORAGE RECEPTACLE

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 234 days.

(21) Appl. No.: 16/214,981

(22) Filed: Dec. 10, 2018

(65) Prior Publication Data

US 2020/0182535 A1 Jun. 11, 2020

(51) Int. Cl.
*F25D 23/12* (2006.01)
*F25C 5/20* (2018.01)

(52) U.S. Cl.
CPC ..... *F25D 23/126* (2013.01); *F25C 5/22* (2018.01); *F25C 2600/04* (2013.01); *F25D 2323/121* (2013.01); *F25D 2323/122* (2013.01); *F25D 2400/361* (2013.01)

(58) Field of Classification Search
CPC ..... F25D 23/126; F25D 2323/121; F25D 2323/122
See application file for complete search history.

(56) References Cited

U.S. PATENT DOCUMENTS 2,341,872 A * 2/1944 Kasold ..... F25D 23/126 165/63
2,777,304 A 1/1957 Nave
2,781,153 A * 2/1957 Roberts ..... F25D 23/126 222/183
3,208,641 A 9/1965 Brugioni
4,255,937 A * 3/1981 Ehrlich ..... C02F 1/325 62/264
4,715,401 A 12/1987 Staun et al.
5,490,547 A * 2/1996 Abadi ..... B67D 3/0009 141/21
5,511,388 A * 4/1996 Taylor ..... B01D 5/0039 62/238.5
5,542,265 A * 8/1996 Rutland ..... B67D 1/0004 222/146.6
5,560,393 A 10/1996 Clack
5,768,905 A * 6/1998 Oh ..... B67D 1/0858 62/264
5,813,246 A * 9/1998 Oh ..... B67D 1/0835 137/614.04

(Continued)

FOREIGN PATENT DOCUMENTS

CN 1707206 A 12/2005
CN 1964913 A 5/2007

(Continued)

OTHER PUBLICATIONS

U.S. Patent Office; Office Action issued in U.S. Appl. No. 15/715,887 dated Jan. 10, 2019.

(Continued)

*Primary Examiner* — Nelson J Nieves

(74) *Attorney, Agent, or Firm* — Middleton Reutlinger

(57) ABSTRACT

A refrigerator utilizes a quick fill dispenser that incorporates a fluid storage receptacle that is easily removable for cleaning and/or dispensing independently of the refrigerator.

29 Claims, 6 Drawing Sheets

(56) References Cited

U.S. PATENT DOCUMENTS

| | | | | |
|---|---|---|---|---|
| 5,857,596 | A | 1/1999 | Lee | |
| 5,971,213 | A | 10/1999 | Lee | |
| 6,003,734 | A * | 12/1999 | Oh | B67D 3/0003 141/351 |
| 6,418,742 | B1 | 7/2002 | Chaney | |
| 6,648,187 | B1 | 11/2003 | Shypkowski | |
| 7,076,966 | B2 * | 7/2006 | Mullen | B67D 3/0009 222/132 |
| 7,399,041 | B2 | 7/2008 | Prentner et al. | |
| 7,596,964 | B2 | 10/2009 | Lim et al. | |
| 7,658,212 | B2 * | 2/2010 | Meuleners | F25D 23/126 141/82 |
| 8,118,178 | B2 | 2/2012 | Olesiewicz et al. | |
| 8,763,422 | B2 | 7/2014 | Zentner et al. | |
| 9,115,930 | B2 | 8/2015 | Park et al. | |
| 9,568,240 | B2 | 2/2017 | Hall et al. | |
| 9,651,296 | B2 | 5/2017 | An | |
| 9,709,321 | B2 | 7/2017 | Yang | |
| 9,752,820 | B2 | 9/2017 | Yang | |
| 10,563,909 | B2 * | 2/2020 | Scalf | B67D 1/1202 |
| 2007/0000949 | A1 | 1/2007 | Bosi | |
| 2008/0168791 | A1 * | 7/2008 | Nebbia | F25D 23/126 62/389 |
| 2009/0126392 | A1 | 5/2009 | An et al. | |
| 2010/0031675 | A1 * | 2/2010 | Kim | F25C 5/185 62/73 |
| 2010/0275633 | A1 | 11/2010 | An et al. | |
| 2010/0293986 | A1 | 11/2010 | Jung | |
| 2011/0232312 | A1 * | 9/2011 | Bortoletto | F25D 17/042 62/274 |
| 2011/0303693 | A1 | 12/2011 | Culley et al. | |
| 2012/0111031 | A1 | 5/2012 | Lee et al. | |
| 2012/0195577 | A1 | 8/2012 | Lee | |
| 2012/0297814 | A1 | 11/2012 | Kim et al. | |
| 2013/0105513 | A1 | 5/2013 | Krause et al. | |
| 2013/0108249 | A1 | 5/2013 | Krause et al. | |
| 2014/0217121 | A1 | 8/2014 | Fernandez | |
| 2015/0197417 | A1 | 7/2015 | Stagg et al. | |
| 2016/0209108 | A1 | 7/2016 | Bird | |
| 2020/0030725 | A1 * | 1/2020 | Laible | B01D 35/1573 |

FOREIGN PATENT DOCUMENTS

| | | | |
|---|---|---|---|
| CN | 102209682 | A | 10/2011 |
| CN | 102374715 | A | 3/2012 |
| CN | 102374742 | A | 3/2012 |
| CN | 105371576 | A | 3/2016 |
| CN | 106642953 | A | 5/2017 |
| CN | 207113363 | U | 3/2018 |
| JP | S61163490 | A | 7/1986 |
| KR | 20120039885 | A | 4/2012 |
| KR | 20130061430 | A | 6/2013 |
| WO | WO2010119016 | A2 | 10/2010 |

OTHER PUBLICATIONS

U.S. Patent Office; Corrected Notice of Allowance issued in U.S. Appl. No. 15/715,887 dated Jan. 14, 2020.

International Search Report and Written Opinion issued is Application No. PCT/CN2019/094321 dated Sep. 26, 2019.

GE, GE WR17X11440 Water Tank Dispenser Assembly for Refrigerator, www.amazon, Retrieved on Sep. 14, 2018.

Amazon, Leakproof 1-Gallon Refrigerator Water Bottle with Faucet & Screw Cap, www.amazon.com, Retrieved on Sep. 14, 2018.

Transmittal of Related Applications.

2-Faucet Beer Refrigerator, Beverage Factory, May 19, 2017.

International Search Report and Written Opinion issued in Application No. PCT/CN2018/074179 dated Jun. 13, 2018.

U.S. Patent Office; Notice of Allowance issued in U.S. Appl. No. 15/715,887 dated Oct. 8, 2019.

* cited by examiner

REFRIGERATOR WITH QUICK FILL DISPENSER INCORPORATING REMOVABLE FLUID STORAGE RECEPTACLE

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Many residential refrigerators also include as a convenience feature an integrated dispenser for dispensing a fluid (e.g., water) and/or ice. In addition, some refrigerators incorporate a water tank or other fluid storage receptacle that may be fixed or removable, and positioned within a cooled compartment of the refrigerator to cool the contained fluid prior to dispensing or otherwise serving (e.g., in the case where the receptacle is removable). However, in many cases such dispensers are only capable of dispensing fluids at lower flow rates, and as a result, filling larger containers from a dispenser can take an inordinate amount of time with many dispensers.

SUMMARY

The herein-described embodiments address these and other problems associated with the art by providing a refrigerator that utilizes a quick fill dispenser that incorporates a fluid storage receptacle that is easily removable for cleaning and/or dispensing independently of the refrigerator.

Therefore, consistent with one aspect of the invention, a refrigerator may include a cabinet including a case having one or more food storage compartments defined therein and one or more doors positioned to insulate the one or more food storage compartments from an exterior environment, and a fluid dispenser coupled to the cabinet and including a fluid dispenser outlet configured to dispense a fluid in response to user input. The fluid dispenser may further includes a fill valve configured to supply a fluid, a fluid dispensing valve configured to regulate fluid flow to the fluid dispenser outlet, a dock in upstream fluid communication with the fluid dispensing valve through a dispense port, and a fluid storage receptacle removably supported by the dock and including a receptacle body, an inlet and an outlet, the receptacle body configured to store fluid, the inlet in downstream fluid communication with the fill valve when the fluid storage receptacle is removably supported by the dock to receive the fluid supplied by the fill valve, and the outlet in upstream fluid communication with the fluid dispensing valve through the dock when the fluid storage receptacle is removably supported by the dock, where the outlet further includes a downwardly-facing outlet port that mates with the dispense port of the dock when the fluid storage receptacle is removably supported by the dock, and the outlet port is sized and configured to provide a fluid dispense rate to the fluid dispensing valve that is greater than a fluid supply rate provided to the inlet of the fluid storage receptacle by the fill valve.

Also, in some embodiments, the outlet port further includes a seal assembly configured to seal the outlet port when the fluid storage receptacle is removed from the dock. Further, in some embodiments, the seal assembly is normally biased to a closed position and is movable to an open position when the fluid storage receptacle is supported by the dock. In some embodiments, the seal assembly includes a spring-loaded plunger having a sealing surface that seals the outlet port when in the closed position.

Also, in some embodiments, the outlet port of the fluid storage receptacle mates with the dispense port of the dock along a mating axis, the spring-loaded plunger is movable along the mating axis, and the dispense port of the dock includes an actuator configured to engage and displace the spring-loaded plunger along the mating axis when the fluid storage receptacle is supported by the dock and thereby move the seal assembly to the open position. In some embodiments, the fluid dispenser further includes a fill nozzle in downstream fluid communication with the fill valve and positioned opposite the inlet of the fluid storage receptacle to supply fluid to the inlet of the fluid storage receptacle when the fluid storage receptacle is supported by the dock. Further, in some embodiments, the inlet is upward-facing and the nozzle is downwardly-facing.

In some embodiments, the fluid storage receptacle includes a removable top, and the inlet is disposed in the removable top of the fluid storage receptacle. Further, in some embodiments, the fill nozzle and the inlet of the fluid storage receptacle are separated by a gap when the fluid storage receptacle is supported by the dock. Also, in some embodiments, the fill nozzle includes a flexible tube configured to deflect when the fluid storage receptacle is inserted into the dock.

In addition, in some embodiments, the dock further includes a fill port in downstream fluid communication with the fill valve, and the inlet of the fluid storage receptacle includes a downwardly-facing inlet port that mates with the fill port of the dock when the fluid storage receptacle is removably supported by the dock. In some embodiments, the inlet port further includes a seal assembly configured to seal the inlet port when the fluid storage receptacle is removed from the dock.

In addition, in some embodiments, the fluid storage receptacle includes a bottom support surface configured to support the fluid storage receptacle on a flat surface when the fluid storage receptacle is removed from the dock, and the outlet port is recessed within the bottom support surface. Also, in some embodiments, the fluid storage receptacle includes a bottom skirt that extends about at least a portion of a periphery of the fluid storage receptacle and below the outlet port, and at least a portion of the bottom support surface is defined by the bottom skirt.

In addition, in some embodiments, the fluid storage receptacle includes a handle for use in carrying the fluid storage receptacle when the fluid storage receptacle is removed from the dock. In some embodiments, the fluid storage receptacle includes a pour spout for use in pouring fluid from the fluid storage receptacle when the fluid storage receptacle is removed from the dock.

Further, in some embodiments, the dock is mounted on a first door among the one or more doors, the fluid storage receptacle is accessible from an interior side of the first door, and the fluid dispenser outlet is an externally-accessible fluid dispenser outlet configured to dispense fluid when the one or more doors are in a closed position. In addition, in some embodiments, the dock is mounted within a receptacle compartment in the first door, the fluid storage receptacle is received within the receptacle compartment when supported by the dock, and the first door further includes a removable panel that covers the receptacle compartment.

Some embodiments may further include a controller coupled to the fill valve, the fluid dispensing valve and a fluid level sensor positioned to sense a level of fluid in the fluid storage receptacle, the controller configured to selectively activate the fill valve to fill the fluid storage receptacle in response to the level of the fluid sensed by the fluid level sensor falling below a predetermined level, and to selectively activate the fluid dispensing valve in response to user input to perform a quick fill operation at a flow rate that is greater than the fluid supply rate.

Consistent with another aspect of the invention, a fluid storage receptacle for use in a fluid dispenser disposed in a refrigerator of a type including a case having one or more food storage compartments defined therein and one or more doors positioned to insulate the one or more food storage compartments from an exterior environment, and the fluid dispenser of a type including a dock in upstream communication with a fluid dispensing valve, may include a receptacle body configured to store a fluid, an inlet configured to receive fluid from a fill valve of the fluid dispenser when the receptacle body is removably supported by the dock, and an outlet configured to supply fluid stored in the receptacle body to the fluid dispensing valve of the fluid dispenser when the receptacle body is removably supported by the dock. The outlet further includes a downwardly-facing outlet port that mates with a dispense port of the dock when the receptacle body is removably supported by the dock, and the outlet port is sized and configured to provide a fluid dispense rate to the fluid dispensing valve that is greater than a fluid supply rate provided to the inlet of the fluid storage receptacle by the fill valve.

Moreover, in some embodiments, the outlet port further includes a seal assembly configured to seal the outlet port when the receptacle body is removed from the dock, where the seal assembly is normally biased to a closed position and is movable to an open position when the receptacle body is supported by the dock. Further, in some embodiments, the seal assembly includes a spring-loaded plunger having a sealing surface that seals the outlet port when in the closed position, the outlet port mates with the dispense port of the dock along a mating axis, the spring-loaded plunger is movable along the mating axis, and the spring-loaded plunger is configured to be displaced along the mating axis into the open position by an actuator disposed in the dispense port of the dock when the receptacle body is supported by the dock.

In some embodiments, the inlet is upwardly-facing, the fluid storage receptacle includes a removable top, and the inlet is disposed in the removable top of the fluid storage receptacle. Moreover, in some embodiments, the inlet further includes a downwardly-facing inlet port that mates with a fill port in the dock when the receptacle body is removably supported by the dock. Further, in some embodiments, the inlet port further includes a seal assembly configured to seal the inlet port when the receptacle body is removed from the dock.

In addition, some embodiments may also include a bottom support surface configured to support the receptacle body on a flat surface when the receptacle body is removed from the dock, and the outlet port is recessed within the bottom support surface. Some embodiments may also include a bottom skirt that extends about at least a portion of a periphery of the receptacle body and below the outlet port, and at least a portion of the bottom support surface is defined by the bottom skirt. In addition, some embodiments may further include a handle for use in carrying the receptacle body when the receptacle body is removed from the dock. Some embodiments may also include a pour spout for use in pouring fluid from the receptacle body when the receptacle body is removed from the dock.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
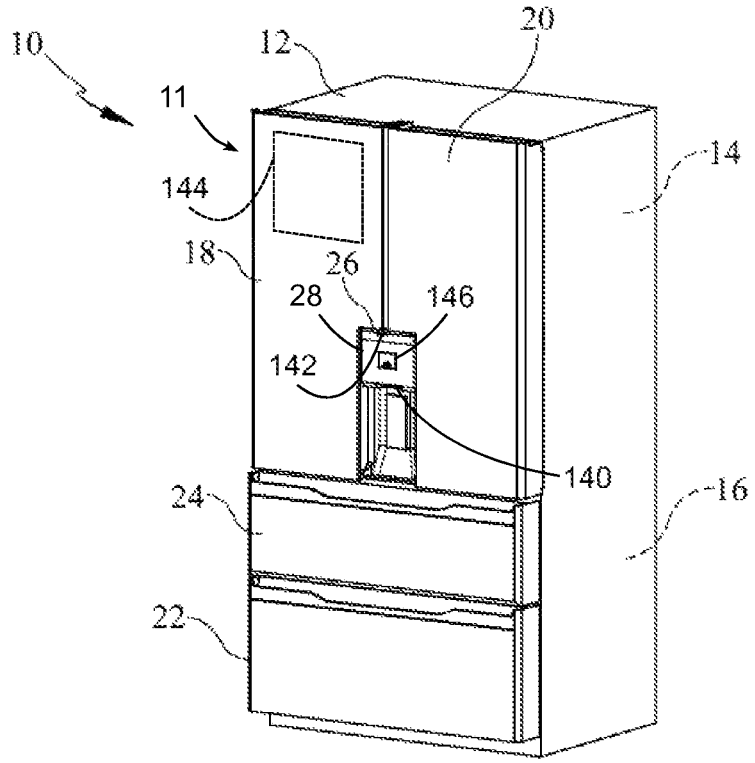
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet 11 including a case 12 (representing the fixed portion or main body of the refrigerator) having one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a pair of sliding freezer compartment doors 22, 24 that are similar to drawers and that pull out to provide access to items in the freezer compartment. Both the fresh food compartment and the freezer compartment may be considered to be full width as they extend substantially across the full width of the case 12. It will be appreciated, however, that other compartment door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a dispenser 26 for dispensing ice and/or a fluid such as water. In the illustrated embodiments, dispenser 26 is an ice and water dispenser capable of dispensing both ice (cubed and/or crushed) and chilled water, while in other embodiments, dispenser 26 may be a fluid only dispenser for dispensing various fluids such as chilled or cooled water, hot water, coffee, beverages, or other fluids, and may have variable rate and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 28, which in the illustrated embodiment forms at least a portion of an exterior surface of an ice compartment of case 12, and further is separate from a fresh food or freezer compartment door such as any of doors 18, 20, 22, and 24. Control panel 28 may include various input/output controls such as buttons, indicator lights, alphanumeric displays, dot matrix displays, touch-sensitive displays, etc. for interacting with a user. In other embodiments, control panel 28 may be separate from dispenser 26 (e.g., on a door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
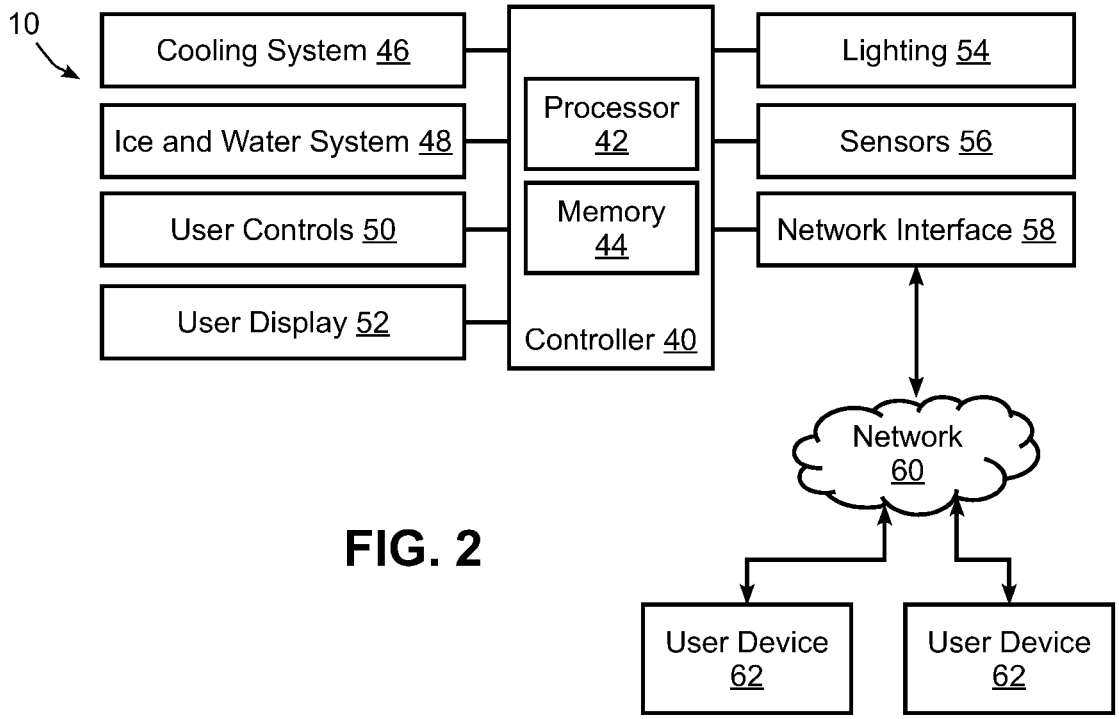
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. At least a portion of user controls 50 and user displays 52 may be disposed, for example, on control panel 28 of FIG. 1.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 3:
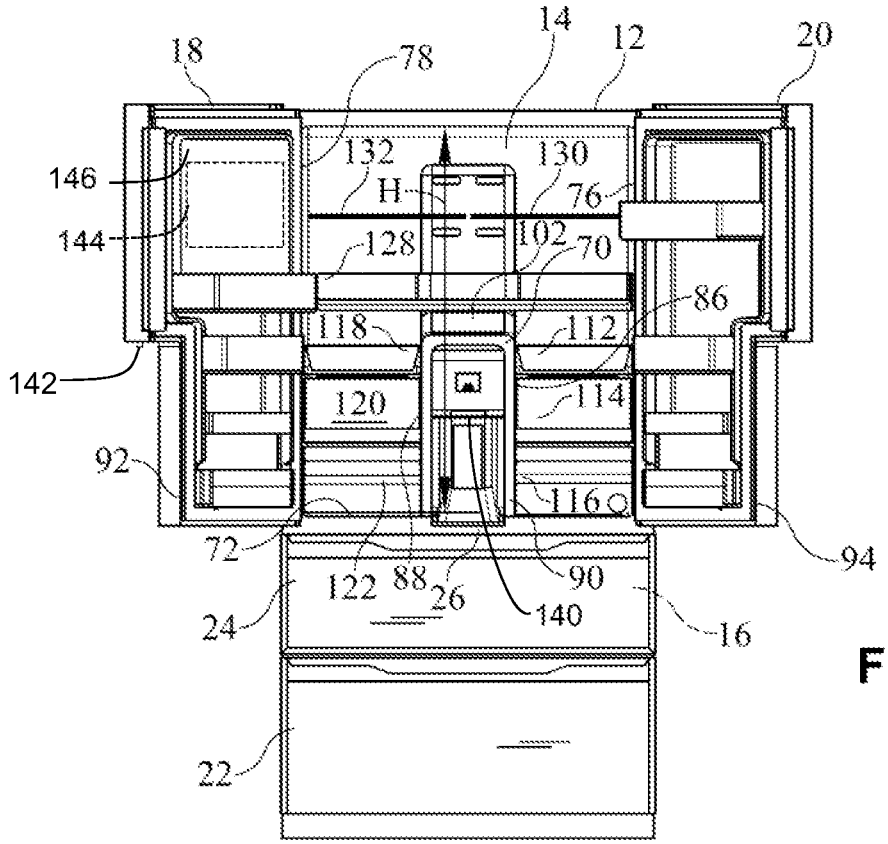
FIG. 3 is a front elevational view of the refrigerator of FIG. 1 with the fresh food compartment doors open.
Figure 4:
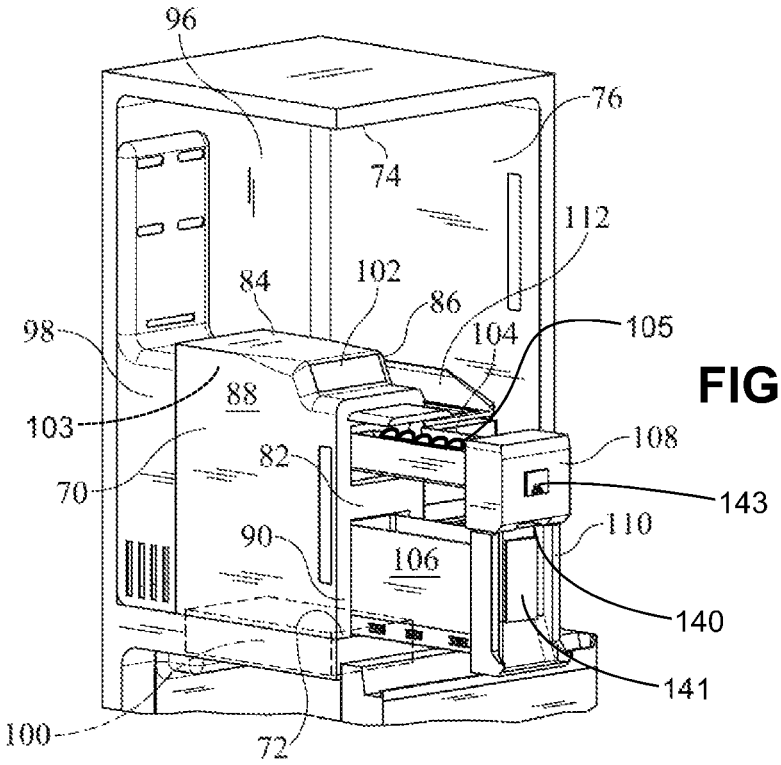
FIG. 4 is an exploded perspective view of the icemaking console for the refrigerator of FIG. 1.

Now turning to FIGS. 3 and 4, in some embodiments, a quick fill dispenser incorporating a removable fluid storage receptacle as described herein may be used in connection with an icemaking console disposed at least partially within a fresh food compartment and extending only a portion of the height of the fresh food compartment, e.g., as disclosed in U.S. patent application Ser. No. 15/835,953 and U.S. patent application Ser. No. 15/836,035, both filed on Dec. 8, 2017 by Eric Scalf, and both incorporated by reference herein. In particular, an icemaking console 70 may be disposed in fresh food compartment 14 and may extend upwardly from a bottom wall 72 of the fresh food compartment 14 only a portion of a height H of the fresh food compartment and spaced apart from each of a top wall 74, right side wall 76, and left side wall 78 of the fresh food compartment. Console 70 may include a front wall 82, top wall 84, right side wall 86 and left side wall 88, and in some instances, at least portions of front wall 82 may be externally-accessible when doors 18, 20 are closed. In some instances, for example, front wall 82 may include a sealing surface 90 against which gaskets 92, 94 on doors 18, 20 may form a seal when doors 18, 20 are closed.

Console 70 may extend in some instances to a back wall 96 of fresh food compartment 14, while in other instances, and as shown in FIG. 4, a separate housing 98 may project from back wall 96 (e.g., formed integrally with back wall 96, or formed as a separate component that is fastened or otherwise attached to back wall 96). Housing 98 may be used, for example, to provide space for an evaporator and/or other cooling system component, for control electronics, for air ducts, or for other suitable purposes.

Moreover, the walls 82, 84, 86 and 88 of console 70 may be insulated (e.g., via foam or another suitable insulator) such that console 70 is an insulated console and such that an interior compartment of console 70 is maintained at a below-freezing temperature for the purposes of making and storing ice. In the illustrated embodiment, console 70 is in fluid communication with freezer compartment 16 through an opening 100 formed in bottom wall 72 of fresh food compartment 14, such that while console 70 is physically disposed within the boundary of fresh food compartment 14, the interior of console 70 is insulated from the fresh food compartment and in fluid communication with freezer compartment 16, thus effectively operating as an extension of freezer compartment 16. In other embodiments, console 70 may be separate from freezer compartment 16, e.g., insulated from freezer compartment 16 and including a separate cooling system, e.g., a thermoelectric cooling system, or separated from freezer compartment 16 but fluidly coupled via ducts or vents to receive cool air circulated by the freezer compartment cooling system. In each instance, however, the interior of console 70 may be considered to be a compartment that is separate from the food storage compartments (fresh food compartment 14 and freezer compartment 16) of refrigerator 10.

Further, it will be appreciated that console 70 is formed separate from the shell or liner used to form the fresh food and/or freezer compartments. In other embodiments, however, console 70 may be formed integrally with the shell or liner of a fresh food and/or freezer compartment.

Console 70 in some embodiments may also provide a convenient location for a control panel 102 suitable for controlling various functions of refrigerator 10. For example, control panel 102 may include displays, buttons, sliders, switches, etc., and may be used to perform various control operations such as setting temperature setpoints, controlling ice and/or water functions, displaying alarms or alerts, etc. As shown in the illustrated embodiment, top wall 84 of console 70 may be bi-level to accommodate control panel 102, although in other embodiments, no control panel may be used, and top wall 84 may be at a substantially consistent elevation along its depth.

Console 70 in some instances may be an icemaking console insofar as the console is used to make, dispense and/or store ice, e.g., as may be produced by an icemaker 103. As will become more apparent below, however, console 70 may not be an icemaking console in some embodiments. In some embodiments, however, console 70 may be configured to receive one or more drawers or storage bins, e.g., upper and lower ice storage bins 104, 106, with an ice dispenser 105 (e.g., a driven auger with selective crushing capability) disposed in upper ice storage bin 104. Upper ice storage bin 104 includes a front face 108 that insulates console 70 from the external environment when the bin is pushed into the console and forms a front surface of the upper ice storage bin, while lower ice storage bin 106 includes a front face 110 that similarly insulates console 70 from the external environment when the bin is pushed into the console and forms a front surface of the lower ice storage bin. Front faces 108, 110 also house at least a portion of an externally-accessible ice and water dispenser, discussed in greater detail below. In some embodiments, a single front face may be used, whereby the upper and lower ice storage bins may be coupled to the same front face.

Beyond ice-related functions, however, console 70 also provides a number of structural features associated with the storage of food items within fresh food compartment 14. For example, side walls 86, 88 of console 70 respectively face side walls 76, 78 of fresh food compartment 14, and may provide structural support for one or more sliding storage elements (e.g., storage elements 112, 114, 116, 118, 120, 122) within fresh food compartment 14. A storage element within the context of the disclosure may include any structural member capable of storing or otherwise supporting a food item, e.g., a shelf, a basket, a storage bin, a drawer, a rack, etc., and a sliding storage element may be considered to be a storage element capable of sliding within a horizontal plane, e.g., along a generally horizontal axis extending from the rear to the front of refrigerator 10.

Storage elements 112 and 118, for example, are sliding shelves, while storage elements 114, 116, 120 and 122 are sliding storage bins or drawers. It will also be appreciated that storage bins or drawers may be configured with customizable environmental conditions (e.g., different temperatures, humidity levels, etc.) suitable for storing food items such as meats, cheeses, vegetables, fruits, etc. Further, not all of storage elements 114-122 need be configured as sliding storage elements, and moreover, different numbers and types of storage elements may be used for any of the storage elements illustrated in FIGS. 3-4, so the invention is not limited to the particular combination of storage elements illustrated herein. Console 70 may also provide structural support for storage elements located above the console, e.g., full width shelf 128, which is disposed underneath a pair of non-sliding shelves 130, 132 (which could also be sliding shelves in some embodiments as well).

With additional reference to FIG. 1, refrigerator 10 also includes an ice and water system including ice and water dispensers having respective ice dispenser and water dispenser outlets 140, 142 that, while outputting to the same general area, are separated from one another to the extent that ice dispenser outlet 140 is case-mounted and positioned within a dispenser opening to dispense ice from a case-mounted icemaker (icemaker 103), while water dispenser outlet 142 is door-mounted. Furthermore, despite the fact that water dispenser outlet 142 is door-mounted in refrigerator 10, a water dispenser control used to actuate the dispenser may be case-mounted in some embodiments. For example, in some embodiments, a water dispenser may be actuated by a water dispenser button or paddle 143 (FIG. 4), while in other embodiments, a water dispenser may be actuated by a control that is common to both the water dispenser and the ice dispenser, e.g., a button or paddle 141 (FIG. 4).

It will be appreciated, however, that in other embodiments, various components associated with a fluid and/or ice dispenser may be mounted on or within a door, on or within a case, or elsewhere in a refrigerator. Accordingly, the invention is not limited to the specific refrigerator and dispenser design illustrated in FIGS. 1-4.

As noted above, in embodiments consistent with the invention, a quick fill fluid dispenser, e.g., for dispensing a fluid such as chilled or cooled water, hot water, coffee, or another beverage, may incorporate a removable fluid storage receptacle consistent with some embodiments of the invention. With reference to FIG. 3, in some embodiments, a fluid storage receptacle, e.g., as represented at 144, may be disposed, for example, within a door of the refrigerator, e.g., door 18. As will also become more apparent below, in some embodiments a fluid storage receptacle may be disposed within an open recess or compartment in a door, while in other embodiments, e.g., as illustrated in FIG. 3, a fluid storage receptacle may be disposed within a closed compartment and accessed by removing or opening a door or panel 146 in a door. In still other embodiments, a fluid storage receptacle may be disposed elsewhere in other user-accessible locations, e.g., on or within case 11, or on or within another door of refrigerator 10.

Figure 5:
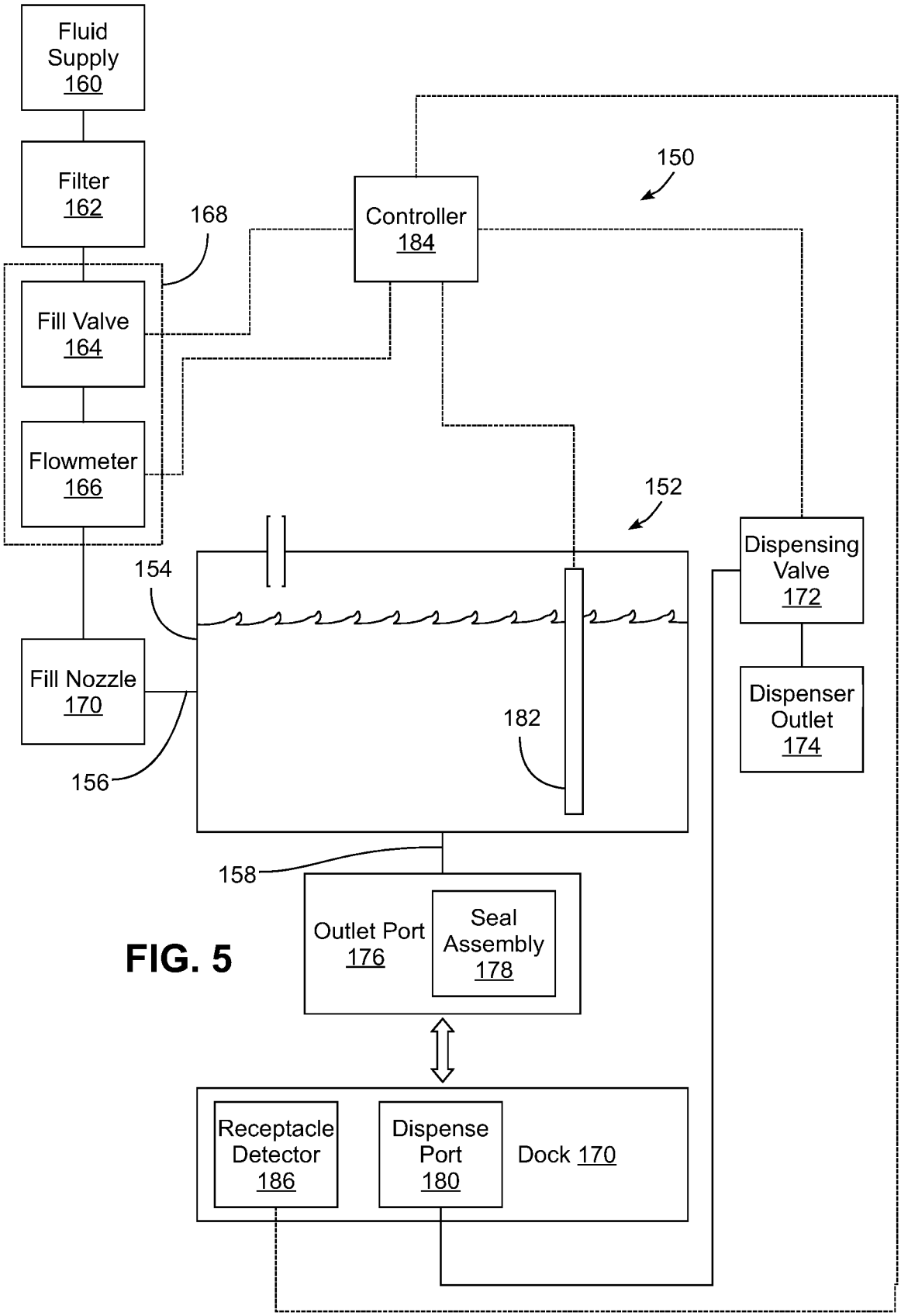
FIG. 5 is a block diagram of an example quick fill dispenser incorporating a removable fluid storage receptacle consistent with some embodiments of the invention.

Now turning to FIG. 5, this figure shows more generically a quick fill fluid dispensing system 150 suitable for use in a refrigerator such as refrigerator 10 of FIGS. 1-4, and incorporating a removable fluid storage receptacle 152 as described herein. Further details regarding the operation and configuration of a quick fill dispenser may also be found in U.S. patent application Ser. No. 15/715,887, filed on Sep. 26, 2017 by Eric Scalf et al., which is incorporated by reference herein.

Fluid storage receptacle 152 includes a container body 154 that stores a fluid such as water, an inlet 156, and an outlet 158, with the inlet coupled to and in downstream fluid communication with a fluid supply 160 (e.g., a supply line configured to be coupled to a residential water source) through a filter 162 (which may be user-replaceable in some embodiments) and receptacle fill valve 164, the latter of which controls a flow of fluid into the fluid storage receptacle. In addition, in some embodiments a flowmeter 166 or other suitable sensor may also be in upstream fluid communication with inlet 154 of receptacle 152 to generate a signal representative of a volume of fluid entering receptacle 152. In some embodiments, valve 164 and flowmeter 166 may be separate components, while in other embodiments, and as illustrated by box 168, these components may be integrated with one another in the same housing.

Fluid storage receptacle 152 is configured to be removably supported by a dock 170 that is in upstream communication with a fluid dispensing valve 172 that regulates fluid flow to a fluid dispenser outlet 174, e.g., an internally-accessible or externally-accessible fluid dispenser outlet disposed on a door or case of a refrigerator. Outlet 158 of fluid storage receptacle 152 includes an outlet port 176 that includes a seal assembly 178 that seals the outlet port when fluid storage receptacle 152 is removed from dock 170. Outlet port 176 in the illustrated embodiments is downwardly-facing, i.e., facing in a downward direction when fluid storage receptacle 152 is supported by dock 170 within a refrigerator. Moreover, outlet port 176 is sized and configured to provide a fluid dispense rate to fluid dispensing valve 172 that is greater than a fluid supply rate provided to inlet 156 of fluid storage receptacle 152 by fill valve 164, thereby providing a "quick fill" capability for the dispenser, at least for an amount of fluid corresponding to at least a portion of the fluid retained in fluid storage receptacle 152. Further, in the illustrated embodiment receptacle 152 is vented to enable quick fill capability to be achieved via gravity flow and without the use of a pump (although a pump could be used in some embodiments).

Outlet port 176 is configured to mate with an upwardly-facing dispense port 180 in dock 170 such that, when mated, fluid storage receptacle 152 is placed in fluid communication with dispensing valve 172. As will also become more apparent below, in some embodiments mating of outlet port 176 and dispense port 180 may automatically open seal assembly 178 to permit fluid to flow through ports 176, 180 when fluid storage receptacle 152 is supported by dock 170.

In addition, in some embodiments, a fluid level sensor 182, e.g., a conductivity sensor mounted on a wall of receptacle 152, an ultrasonic sensor positioned to sense a water surface within receptacle 152, a magnetic float sensor, or another suitable sensor, may be downstream of flowmeter 166 and positioned to generate a signal representative of a level of fluid in the receptacle, which in some embodiments may also be usable to represent a volume of fluid exiting the outlet of the fluid storage receptacle during dispensing. In other embodiments, a flowmeter may be used downstream of outlet port 176 to sense the volume of fluid being dispensed. It will be appreciated that volume measurements may be desirable in some embodiments to provide feedback to a user as to the amount of fluid being dispensed and/or to provide a measured fill capability whereby the dispenser automatically shuts off when a user-selected amount of fluid has been dispensed. In other embodiments, however, no volume measurements may be used, although it may still be desirable to include a fluid level sensor, a float switch or other suitable component to cause fluid storage receptacle 152 to be maintained in a substantially filled state whenever docked in dock 170.

Each of valves 164, 172 and sensors 166, 182 is additionally coupled to a controller 184 to enable the controller to selectively activate dispensing valve 172 in response to user input to dispense fluid from fluid storage receptacle 152

(e.g., to perform a quick fill or dispense operation at a flow rate that is greater than the fluid supply rate), to selectively activate fill valve 164 to fill receptacle 152 in response to the level of the fluid sensed by sensor 182 falling below a predetermined level, and in some embodiments to determine a volume of fluid dispensed through dispensing valve 172 using signals generated by sensors 166, 182. It may also be desirable in some embodiments to also include a receptacle detector 186, e.g., a switch or other presence detector, to detect when receptacle 152 is properly docked with dock 170, e.g., to enable each of valves 164, 172 to be disabled whenever receptacle 152 has been removed from dock 170.

Figure 6:
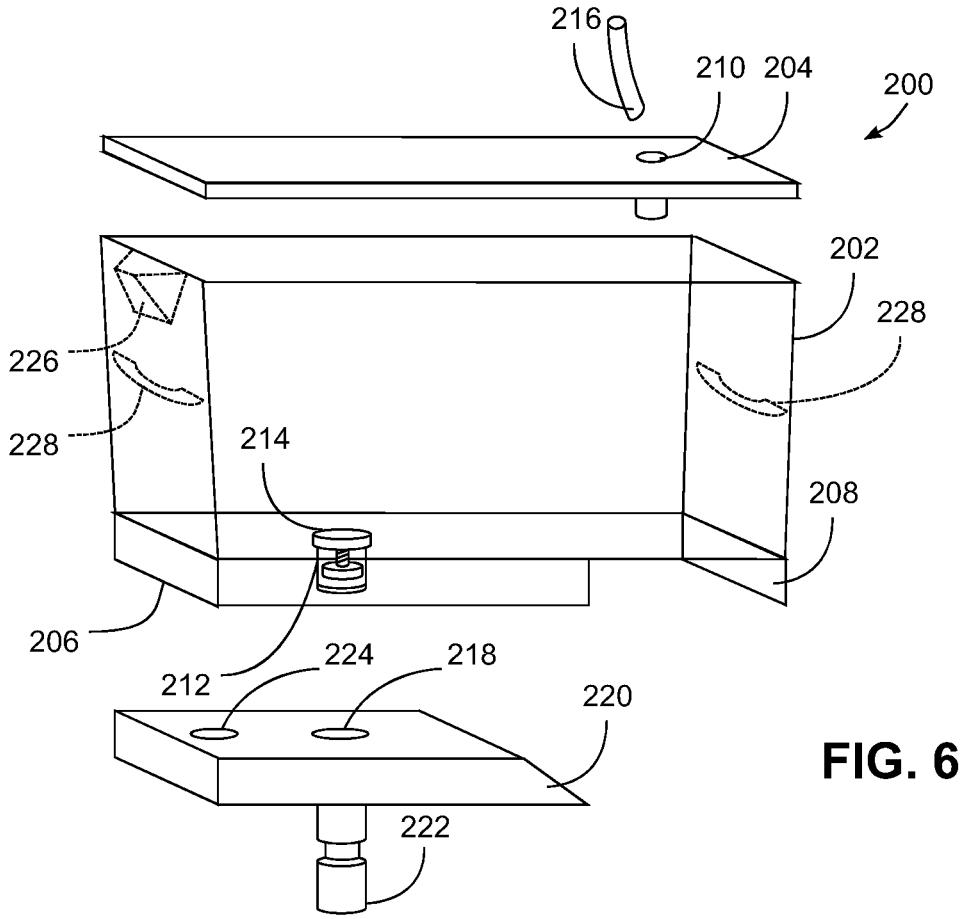
FIG. 6 is an exploded perspective view of an example removable fluid storage receptacle and dock consistent with some embodiments of the invention.

FIG. 6 illustrates an example implementation of a removable fluid storage container 200 consistent with some embodiments of the invention. A container body 202, e.g., formed of a clear, translucent or opaque plastic or another suitable material, may have an open top that is closed by a removable lid or top 204. Container body 202 includes a bottom support surface 206, e.g., defined on a bottom skirt 208 that extends around at least a portion of a periphery of body 202, which may be used to support the receptacle on a flat surface such as a table or countertop when the receptacle is removed from the dock. An inlet 210 for fluid storage container 200 is defined on top 204, and in the illustrated embodiment is open to the atmosphere to vent the receptacle. An outlet for fluid storage container 200 is defined by a downwardly-facing outlet port 212 including a seal assembly 214.

In the illustrated embodiment, inlet 210 receives fluid from a fluid supply through a fill nozzle 216, while outlet port 212 mates with a dispensing port 218 in a dock 220 to output fluid stored in receptacle 200 through a coupler 222 to a dispenser valve to dispense the fluid through a dispenser outlet (not shown in FIG. 6). Dock 220 may also include a receptacle detector 224 (e.g., a pressure-sensitive switch) that senses when receptacle 200 is supported by dock 220.

Fill nozzle 216 is in downstream fluid communication with a fill valve and positioned opposite inlet 210 to supply fluid to the inlet when fluid storage receptacle 200 is supported by dock 220. In the illustrated embodiment, inlet 210 is generally upward-facing and fill nozzle 216 is generally downwardly-facing. Moreover, in some embodiments, fill nozzle 216 and inlet 210 are separated by a gap when the fluid storage receptacle is supported by the dock to facilitate removal of receptacle 200 from dock 220, and further, as illustrated in FIG. 6, fill nozzle 216 may include a flexible tube configured to deflect when the fluid storage receptacle is inserted into the dock.

It will be appreciated that receptacle 200 may include additional components in some embodiments, e.g., a pour spout 226 for use in pouring fluid from the fluid storage receptacle when the fluid storage receptacle is removed from the dock, one or more handles 228 for use in carrying the fluid storage receptacle when the fluid storage receptacle is removed from the dock. Additional components, e.g., a user-actuated dispensing valve, a top-mounted handle, one or more latches to secure the top to the container body, may also be included on receptacle 200 in other embodiments.

Figure 7:
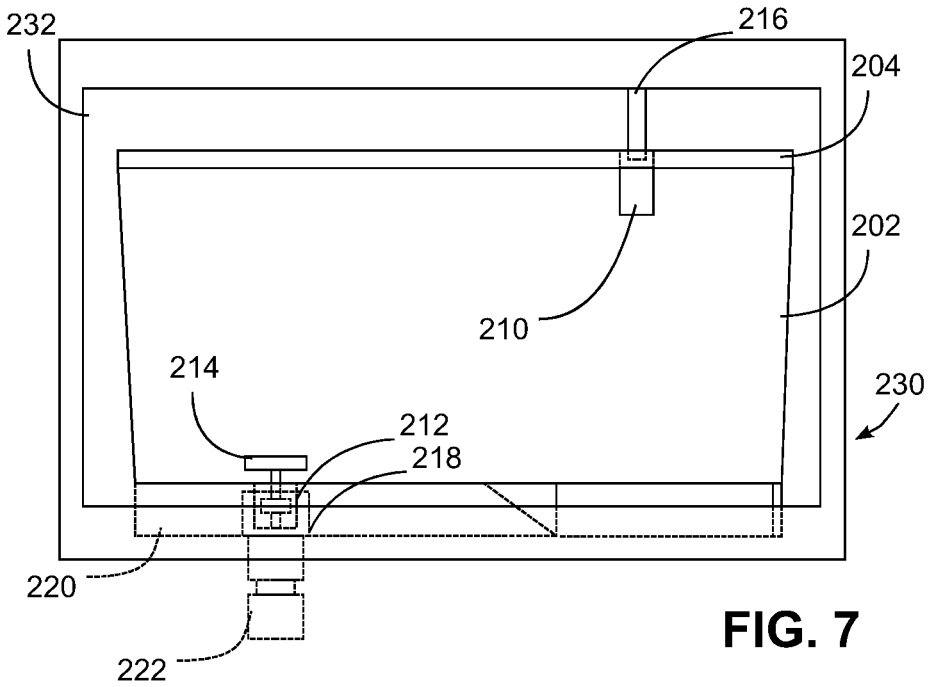
FIG. 7 is an elevational view of an interior side of an example refrigerator door, and illustrating the fluid storage receptacle and dock of FIG. 6 mounted therein.
Figure 8:
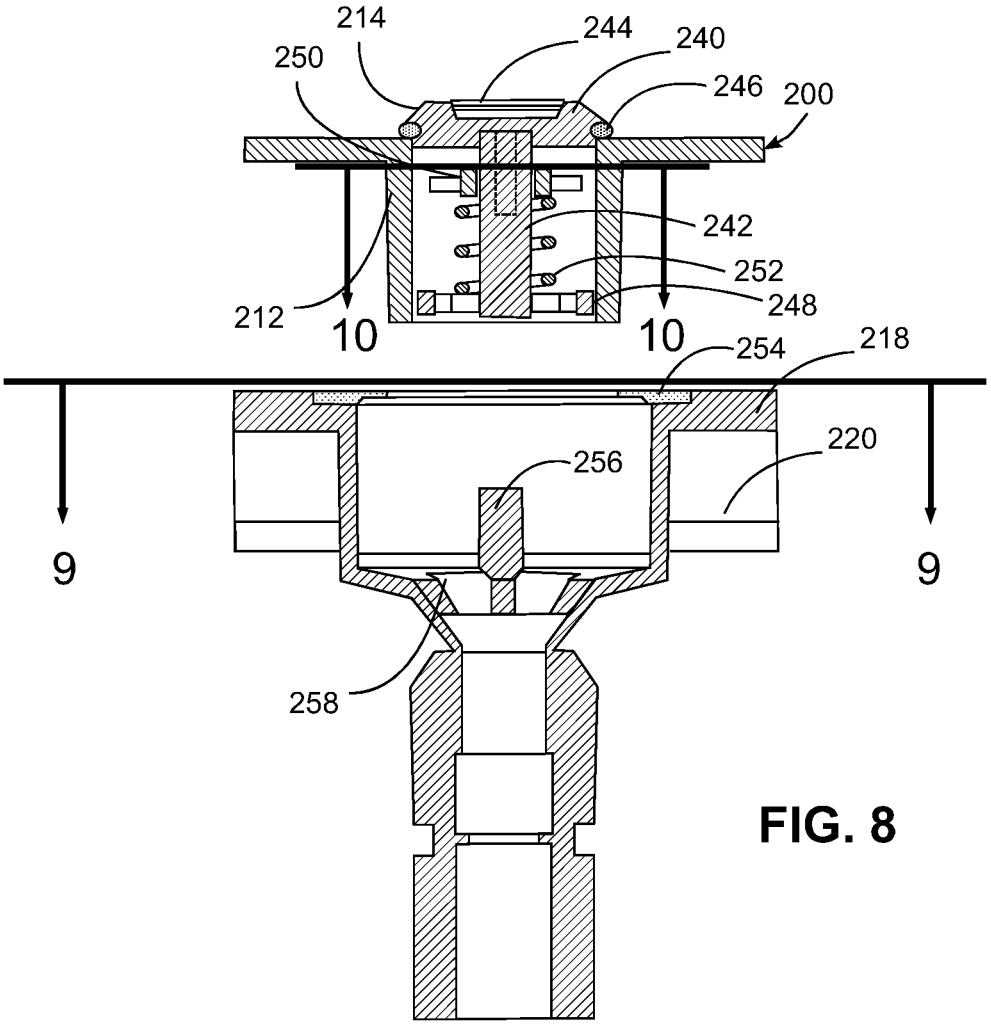
FIG. 8 is a side cross-sectional view of a seal assembly and docking arrangement between the fluid storage receptacle and dock of FIG. 6.
Figure 9:
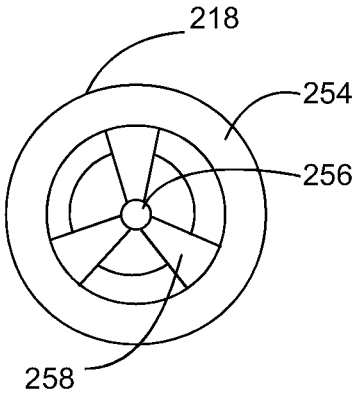
FIG. 9 is a top plan view of the dock of FIG. 6, taken along lines 9-9.
Figure 10:
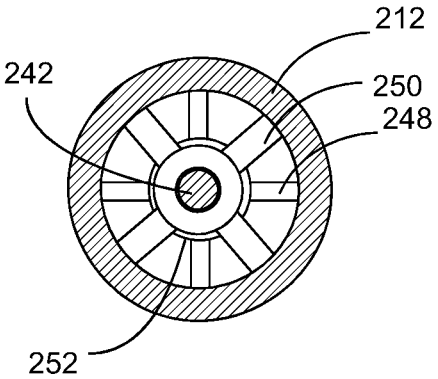
FIG. 10 is a top cross-sectional view of the sealing assembly of FIG. 6, taken along lines 10-10.

As noted above, a removable fluid storage receptacle may be disposed at various locations in a refrigerator. FIG. 7, for example, illustrates an interior side of a door 230, with receptacle 200 received within a receptacle compartment 232 defined in the door and supported by dock 220, which is fixedly mounted in door 230. As noted above, receptacle compartment 232 may be open in some embodiments, as illustrated in FIG. 7, while in other embodiments, a removable door or panel may cover the receptacle compartment, as illustrated in FIG. 3.

When receptacle 200 is received in dock 220, fill nozzle 216 may be partially received within inlet 210, and as such, it may be desirable for fill nozzle 216 to be flexible to enable the fill nozzle to bend or deflect when receptacle 200 is inserted into or removed from compartment 232. In other embodiments, fill nozzle 216 may be mechanically or electro-mechanically movable between a loading/unloading position (where fill nozzle 216 is separated from inlet 210 to enable receptacle 200 to be lifted off of dock 220) and an operating position (where fill nozzle 216 is at least partially inserted into inlet 210).

Now turning to FIGS. 8-11, an example seal assembly 214 docking arrangement suitable for use in receptacle 200 is illustrated in greater detail. Seal assembly 214 is used to seal outlet port 212 when fluid storage receptacle 200 is removed from dock 220, and as such may be normally biased to a closed position and automatically moved to an open position when the receptacle is mated with the dock. In some embodiments, for example, seal assembly 214 may include a spring-loaded plunger having a plunger body 240 that is mated with a central shaft 242 via a plug 244 and that includes an O-ring 246 to form a sealing surface that seals outlet port 212. Shaft 242 includes ported flange 248 that permits fluid flow therethrough (see FIG. 10) and is supported by a ported support 250 formed on or otherwise mounted to outlet port 212 and also permitting fluid flow therethrough. A coiled spring 252 is positioned between ported flange 248 and ported support 250 to bias plunger body 240 to a closed position where O-ring 246 forms a seal between plunger body 240 and outlet port 212.

Figure 11:
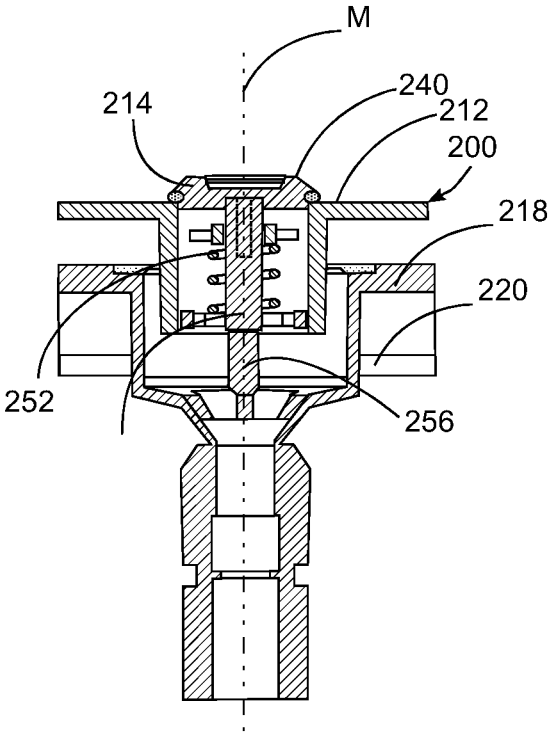
FIGS. 11 and 12 are side cross-sectional views of the seal assembly and docking arrangement of FIG. 6, and illustrating docking of the removable fluid storage receptacle with the dock.
Figure 12:
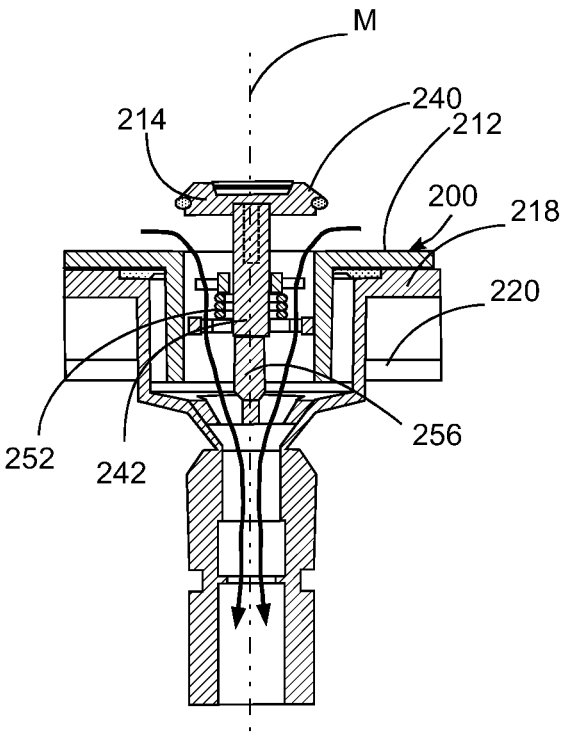

Dispense port 218 in dock 220 includes an annular seal 254 that forms a seal when outlet port 212 is mated with dispense port 218. Dispense port 218 also includes an actuator, e.g., a fixed shaft 256 supported by a ported support 258, which is used to engage and displace plunger body 240 to move the seal assembly 214 to an open position. FIGS. 11 and 12, for example, illustrate actuation of seal assembly 214 during docking of fluid storage receptacle 200 with dock 220. In particular, FIG. 11 illustrates outlet port 212 moving along a mating axis M from the position illustrated in FIG. 8 to a position where shaft 242 of the spring-loaded plunger first engages actuator 256 of dispense port 218. Further movement of outlet port 212 along mating axis M to the position illustrated in FIG. 12 causes actuator 256 to displace shaft 242 along the mating axis M, compressing spring 252 and separating plunger body 240 from outlet port 212 to permit fluid flow through outlet port 212 and dispense port 218. Further, it will be appreciated that annular seal 254 forms a seal between ports 212 and 218.

It will be appreciated that other seal assemblies may be used in other embodiments. Further, in some embodiments a movable actuator (e.g., driven by a solenoid) may be used to selectively open a seal assembly, rather than having the seal assembly automatically opened in response to docking of the receptacle with the dock.

Other variations of a removable fluid receptacle may be used in other embodiments. For example, while receptacle 200 is illustrated with an inlet on a top surface of a top, in other embodiments an inlet may be positioned on the container body, e.g., on a top wall or a side wall, and may be oriented in a direction other than upwardly-facing.

Figure 13:
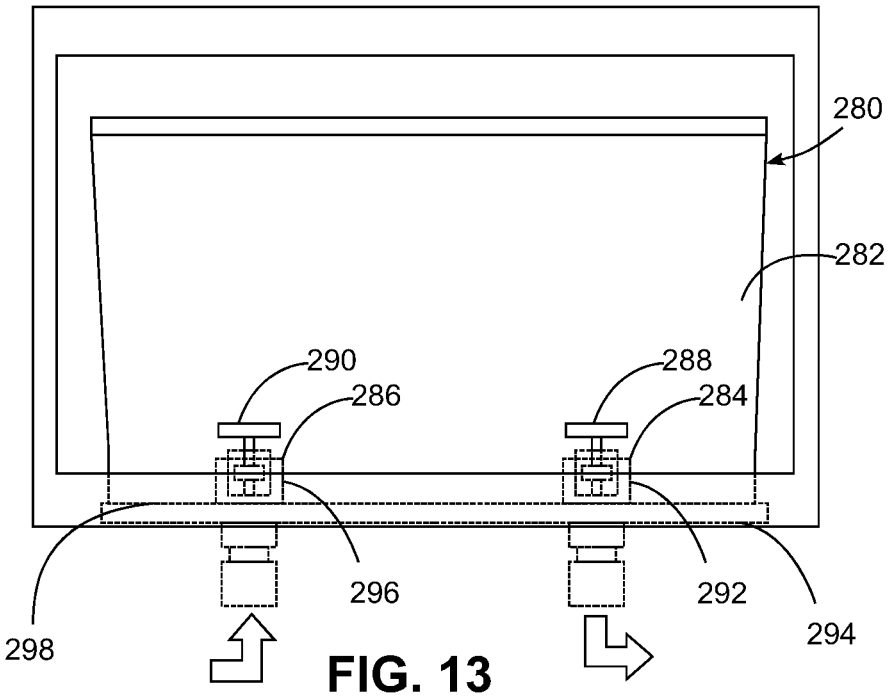
FIG. 13 is an elevational view of an interior side of an example refrigerator door, and illustrating another example implementation of a fluid storage receptacle and dock consistent with some embodiments of the invention.

In addition, as illustrated by fluid storage receptacle 280 of FIG. 13, a container body 282 may include both an outlet port 284 and an inlet port 286, each including a seal assembly 288, 290 similarly configured to seal assembly 214 of receptacle 200. Outlet port 284 may be similarly configured to outlet port 212 of receptacle 200, and may mate with a corresponding dispense port 292 disposed in a dock 294 and similarly configured to dispense port 218 of dock 220. In addition, inlet port 286 may, like outlet port 284, be downwardly-facing and configured to mate with a fill port 296 that is similarly configured to dispense port 286. Upon docking of receptacle 280 with dock 294, each of outlet and inlet ports 284, 286 mate with dispense and fill ports 292, 296 to open seal assemblies 288, 290. As such, receptacle 280 includes both a downwardly-facing inlet and a downwardly-facing outlet on a bottom surface thereof.

FIG. 13 also illustrates an alternate bottom support surface 298 for receptacle body 282, where rather than using a skirt, surface 298 is substantially solid along a bottom side of body 282, and outlet and inlet ports 284, 286 are recessed within surface 298. Other support surfaces may be used in other embodiments.

As such, in the illustrated embodiments a quick fill fluid dispenser incorporates a fluid storage receptacle that is removable from the dispenser. In some embodiments, for example, such a receptacle may be useful when it is desirable to pour or otherwise dispense a large amount of cooled or chilled water. Such a receptacle may also be useful for cleaning purposes, e.g., to remove mold or mildew growth that may occur over time, and as such, a receptacle may be constructed to be dishwasher-safe in some embodiments.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including a case having one or more food storage compartments defined therein and one or more doors positioned to insulate the one or more food storage compartments from an exterior environment; and a fluid dispenser coupled to the cabinet and including a fluid dispenser outlet configured to dispense a fluid in response to user input, the fluid dispenser further including:

a fill valve configured to supply a fluid;

a fluid dispensing valve configured to regulate fluid flow to the fluid dispenser outlet;

a dock in upstream fluid communication with the fluid dispensing valve through a dispense port; and a fluid storage receptacle removably supported by the dock and including a receptacle body, an inlet and an outlet, the receptacle body configured to store fluid, the inlet in downstream fluid communication with the fill valve when the fluid storage receptacle is removably supported by the dock to receive the fluid supplied by the fill valve, and the outlet in upstream fluid communication with the fluid dispensing valve through the dock when the fluid storage receptacle is removably supported by the dock;

wherein the outlet further includes a downwardly-facing outlet port that mates with the dispense port of the dock when the fluid storage receptacle is removably supported by the dock;

wherein the outlet port is sized and configured to provide a fluid dispense rate to the fluid dispensing valve that is greater than a fluid supply rate provided to the inlet of the fluid storage receptacle by the fill valve; and wherein the outlet port further includes a seal assembly configured to seal the outlet port when the fluid storage receptacle is removed from the dock, the seal assembly is normally biased to a closed position and is movable to an open position when the fluid storage receptacle is supported by the dock, and the seal assembly includes a spring-loaded plunger having a sealing surface that seals the outlet port when in the closed position.

2. The refrigerator of claim 1, wherein the outlet port of the fluid storage receptacle mates with the dispense port of the dock along a mating axis, wherein the spring-loaded plunger is movable along the mating axis, and wherein the dispense port of the dock includes an actuator configured to engage and displace the spring-loaded plunger along the mating axis when the fluid storage receptacle is supported by the dock and thereby move the seal assembly to the open position.

3. The refrigerator of claim 1, wherein the fluid dispenser further includes a fill nozzle in downstream fluid communication with the fill valve and positioned opposite the inlet of the fluid storage receptacle to supply fluid to the inlet of the fluid storage receptacle when the fluid storage receptacle is supported by the dock.

4. The refrigerator of claim 3, wherein the inlet is upward-facing and the nozzle is downwardly-facing.

5. The refrigerator of claim 4, wherein the fluid storage receptacle includes a removable top, and wherein the inlet is disposed in the removable top of the fluid storage receptacle.

6. The refrigerator of claim 3, wherein the fill nozzle and the inlet of the fluid storage receptacle are separated by a gap when the fluid storage receptacle is supported by the dock.

7. The refrigerator of claim 3, wherein the fill nozzle includes a flexible tube configured to deflect when the fluid storage receptacle is inserted into the dock.

8. The refrigerator of claim 1, wherein the dock further includes a fill port in downstream fluid communication with the fill valve, and wherein the inlet of the fluid storage receptacle includes a downwardly-facing inlet port that mates with the fill port of the dock when the fluid storage receptacle is removably supported by the dock.

9. The refrigerator of claim 8, wherein the inlet port further includes a second seal assembly configured to seal the inlet port when the fluid storage receptacle is removed from the dock.

10. The refrigerator of claim 1, wherein the fluid storage receptacle includes a bottom support surface configured to support the fluid storage receptacle on a flat surface when the fluid storage receptacle is removed from the dock, and wherein the outlet port is recessed within the bottom support surface.

11. The refrigerator of claim 10, wherein the fluid storage receptacle includes a bottom skirt that extends about at least a portion of a periphery of the fluid storage receptacle and below the outlet port, wherein at least a portion of the bottom support surface is defined by the bottom skirt.

12. The refrigerator of claim 1, wherein the fluid storage receptacle includes a handle for use in carrying the fluid storage receptacle when the fluid storage receptacle is removed from the dock.

13. The refrigerator of claim 1, wherein the fluid storage receptacle includes a pour spout for use in pouring fluid from the fluid storage receptacle when the fluid storage receptacle is removed from the dock.

14. The refrigerator of claim 1, wherein the dock is mounted on a first door among the one or more doors, wherein the fluid storage receptacle is accessible from an interior side of the first door, and wherein the fluid dispenser outlet is an externally-accessible fluid dispenser outlet configured to dispense fluid when the one or more doors are in a closed position.

15. The refrigerator of claim 14, wherein the dock is mounted within a receptacle compartment in the first door, wherein the fluid storage receptacle is received within the receptacle compartment when supported by the dock, and wherein the first door further includes a removable panel that covers the receptacle compartment.

16. The refrigerator of claim 1, further comprising a controller coupled to the fill valve, the fluid dispensing valve and a fluid level sensor positioned to sense a level of fluid in the fluid storage receptacle, the controller configured to selectively activate the fill valve to fill the fluid storage receptacle in response to the level of the fluid sensed by the fluid level sensor falling below a predetermined level, and to selectively activate the fluid dispensing valve in response to user input to perform a quick fill operation at a flow rate that is greater than the fluid supply rate.

17. A refrigerator, comprising:

a cabinet including a case having one or more food storage compartments defined therein and one or more doors positioned to insulate the one or more food storage compartments from an exterior environment; and a fluid dispenser coupled to the cabinet and including a fluid dispenser outlet configured to dispense a fluid in response to user input, the fluid dispenser further including:

a fill valve configured to supply a fluid;

a fluid dispensing valve configured to regulate fluid flow to the fluid dispenser outlet;

a dock in upstream fluid communication with the fluid dispensing valve through a dispense port, wherein the dock further includes a fill port in downstream fluid communication with the fill valve; and a fluid storage receptacle removably supported by the dock and including a receptacle body, an inlet and an outlet, the receptacle body configured to store fluid, the inlet in downstream fluid communication with the fill valve when the fluid storage receptacle is removably supported by the dock to receive the fluid supplied by the fill valve, and the outlet in upstream fluid communication with the fluid dispensing valve through the dock when the fluid storage receptacle is removably supported by the dock;

wherein the inlet of the fluid storage receptacle includes a downwardly-facing inlet port that mates with the fill port of the dock when the fluid storage receptacle is removably supported by the dock;

wherein the outlet further includes a downwardly-facing outlet port that mates with the dispense port of the dock when the fluid storage receptacle is removably supported by the dock; and wherein the outlet port is sized and configured to provide a fluid dispense rate to the fluid dispensing valve that is greater than a fluid supply rate provided to the inlet of the fluid storage receptacle by the fill valve.

18. The refrigerator of claim 17, wherein the inlet port further includes a seal assembly configured to seal the inlet port when the fluid storage receptacle is removed from the dock.

19. The refrigerator of claim 18, wherein the seal assembly is normally biased to a closed position and is movable to an open position when the fluid storage receptacle is supported by the dock, and the seal assembly includes a spring-loaded plunger having a sealing surface that seals the inlet port when in the closed position.

20. The refrigerator of claim 17, wherein the outlet port further includes a seal assembly configured to seal the outlet port when the fluid storage receptacle is removed from the dock, the seal assembly is normally biased to a closed position and is movable to an open position when the fluid storage receptacle is supported by the dock, and the seal assembly includes a spring-loaded plunger having a sealing surface that seals the outlet port when in the closed position.

21. The refrigerator of claim 20, wherein the outlet port of the fluid storage receptacle mates with the dispense port of the dock along a mating axis, wherein the spring-loaded plunger is movable along the mating axis, and wherein the dispense port of the dock includes an actuator configured to engage and displace the spring-loaded plunger along the mating axis when the fluid storage receptacle is supported by the dock and thereby move the seal assembly to the open position.

22. A refrigerator, comprising:

a cabinet including a case having one or more food storage compartments defined therein and one or more doors positioned to insulate the one or more food storage compartments from an exterior environment; and a fluid dispenser coupled to the cabinet and including a fluid dispenser outlet configured to dispense a fluid in response to user input, the fluid dispenser further including:

a fill valve configured to supply a fluid;

a fluid dispensing valve configured to regulate fluid flow to the fluid dispenser outlet;

a dock in upstream fluid communication with the fluid dispensing valve through a dispense port; and a fluid storage receptacle removably supported by the dock and including a receptacle body, an inlet and an outlet, the receptacle body configured to store fluid, the inlet in downstream fluid communication with the fill valve when the fluid storage receptacle is removably supported by the dock to receive the fluid supplied by the fill valve, and the outlet in upstream fluid communication with the fluid dispensing valve through the dock when the fluid storage receptacle is removably supported by the dock;

wherein the outlet further includes a downwardly-facing outlet port that mates with the dispense port of the dock when the fluid storage receptacle is removably supported by the dock;

wherein the outlet port is sized and configured to provide a fluid dispense rate to the fluid dispensing valve that is greater than a fluid supply rate provided to the inlet of the fluid storage receptacle by the fill valve;

wherein the dock is mounted on a first door among the one or more doors, wherein the fluid storage receptacle is accessible from an interior side of the first door, and wherein the fluid dispenser outlet is an externally-accessible fluid dispenser outlet configured to dispense fluid when the one or more doors are in a closed position; and wherein the dock is mounted within a receptacle compartment in the first door, wherein the fluid storage receptacle is received within the receptacle compartment when supported by the dock, and wherein the first door further includes a removable panel that covers the receptacle compartment.

23. The refrigerator of claim 22, wherein the outlet port further includes a seal assembly configured to seal the outlet port when the fluid storage receptacle is removed from the dock, the seal assembly is normally biased to a closed position and is movable to an open position when the fluid storage receptacle is supported by the dock, and the seal assembly includes a spring-loaded plunger having a sealing surface that seals the outlet port when in the closed position.

24. The refrigerator of claim 22, wherein the fluid dispenser further includes a fill nozzle in downstream fluid communication with the fill valve and positioned opposite the inlet of the fluid storage receptacle to supply fluid to the inlet of the fluid storage receptacle when the fluid storage receptacle is supported by the dock, and wherein the inlet is upward-facing and the nozzle is downwardly-facing.

25. The refrigerator of claim 14, wherein the fluid storage receptacle includes a removable top, and wherein the inlet is disposed in the removable top of the fluid storage receptacle.

26. The refrigerator of claim 22, wherein the fluid dispenser further includes a fill nozzle in downstream fluid communication with the fill valve and positioned opposite the inlet of the fluid storage receptacle to supply fluid to the inlet of the fluid storage receptacle when the fluid storage receptacle is supported by the dock, and wherein the fill nozzle and the inlet of the fluid storage receptacle are separated by a gap when the fluid storage receptacle is supported by the dock.

27. The refrigerator of claim 22, wherein the fluid dispenser further includes a fill nozzle in downstream fluid communication with the fill valve and positioned opposite the inlet of the fluid storage receptacle to supply fluid to the inlet of the fluid storage receptacle when the fluid storage receptacle is supported by the dock, and wherein the fill nozzle includes a flexible tube configured to deflect when the fluid storage receptacle is inserted into the dock.

28. The refrigerator of claim 22, wherein the dock further includes a fill port in downstream fluid communication with the fill valve, the inlet of the fluid storage receptacle includes a downwardly-facing inlet port that mates with the fill port of the dock when the fluid storage receptacle is removably supported by the dock, and the inlet port further includes a seal assembly configured to seal the inlet port when the fluid storage receptacle is removed from the dock.

29. The refrigerator of claim 22, further comprising a controller coupled to the fill valve, the fluid dispensing valve and a fluid level sensor positioned to sense a level of fluid in the fluid storage receptacle, the controller configured to selectively activate the fill valve to fill the fluid storage receptacle in response to the level of the fluid sensed by the fluid level sensor falling below a predetermined level, and to selectively activate the fluid dispensing valve in response to user input to perform a quick fill operation at a flow rate that is greater than the fluid supply rate.

* * * * *